US009168780B1

(12) United States Patent
Waddell et al.

(10) Patent No.: US 9,168,780 B1
(45) Date of Patent: Oct. 27, 2015

(54) REMOVABLE INSERT FOR A FILE FOLDER

(71) Applicant: Target Brands, Inc., Minneapolis, MN (US)

(72) Inventors: Matthew A. Waddell, St. Paul, MN (US); Michael A. Deem, Washington, DC (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/590,279

(22) Filed: Jan. 6, 2015

(51) Int. Cl.
*B42F 21/00* (2006.01)
*B42F 7/06* (2006.01)

(52) U.S. Cl.
CPC .. *B42F 21/00* (2013.01); *B42F 7/06* (2013.01)

(58) Field of Classification Search
CPC ..... B42F 19/04
USPC ..... 40/359, 360, 654.01, 771, 776; 229/67.1
See application file for complete search history.

(56) References Cited

U.S. PATENT DOCUMENTS

| | | | | |
|---|---|---|---|---|
| 554,574 | A | 2/1896 | Bennett | |
| 2,274,909 | A | 3/1942 | Murray | |
| 2,677,376 | A | 5/1954 | Brunner | |
| 2,807,265 | A | 9/1957 | Oliva et al. | |
| 2,918,921 | A | 12/1959 | Carlston | |
| 4,108,227 | A * | 8/1978 | Bonner | 383/40 |
| D275,576 | S | 9/1984 | Kirk | |
| D421,050 | S | 2/2000 | Henrikson et al. | |
| D427,632 | S | 7/2000 | McNeil | |
| 6,108,953 | A * | 8/2000 | Hall | 40/359 |
| 6,669,080 | B2 | 12/2003 | Ong | |
| 6,672,439 | B2 | 1/2004 | Platte, III | |
| D493,658 | S | 8/2004 | Hassett | |
| 6,862,827 | B2 * | 3/2005 | Gregory | 40/661 |
| 6,874,968 | B2 | 4/2005 | Schwartz | |
| 6,905,064 | B1 | 6/2005 | Ong | |
| 6,945,399 | B1 | 9/2005 | Ong | |
| D522,575 | S | 6/2006 | Smith | |
| 7,152,351 | B2 * | 12/2006 | Eby et al. | 40/124.2 |
| 7,237,710 | B1 | 7/2007 | Ong | |
| D554,704 | S | 11/2007 | Krepak | |
| D567,286 | S | 4/2008 | Takahashi | |
| 7,597,192 | B2 | 10/2009 | Lee | |
| D690,353 | S | 9/2013 | Bowman et al. | |
| 2002/0089171 | A1 | 7/2002 | Silvestre | |
| 2009/0166400 | A1 | 7/2009 | Lee | |
| 2012/0111930 | A1 | 5/2012 | Maistrellis | |
| 2012/0241507 | A1 | 9/2012 | Rowe et al. | |
| 2014/0182175 | A1 | 7/2014 | Rigas | |
| 2014/0311933 | A1 | 10/2014 | Kuehn et al. | |

* cited by examiner

*Primary Examiner* — Joanne Silbermann
(74) *Attorney, Agent, or Firm* — Leanne Taveggia Farrell; Westman, Champlin & Koehler, P.A.

(57) ABSTRACT

A divider for a file folder includes a primary sheet made of transparent plastic and having an integrally formed tab that protrudes from a top of the primary sheet. The divider further includes a secondary sheet made of transparent plastic and welded to a surface of the primary sheet to define at least one accessory compartment and a tertiary sheet made of transparent plastic and welded to the surface of the primary sheet to define a business card compartment. A portion of the business card compartment is located adjacent to the tab of the primary sheet and is sized to accommodate a business card.

20 Claims, 17 Drawing Sheets

REMOVABLE INSERT FOR A FILE FOLDER

BACKGROUND

File folders provide a way for a person to carry documents, content and the like in an organized, secured, protected and accessible manner. File folders can include a bottom, expandable sides, a top flap and dividers for separating and containing the documents. The dividers can be fixed inside the file folder or can be loose inside the file folder.

The discussion above is merely provided for general background information and is not intended to be used as an aid in determining the scope of the claimed subject matter.

SUMMARY

An insert for a file folder includes a base sheet having a top edge, a bottom edge, a front surface and a back surface. A first portion of the top edge is out-of-alignment with a second portion of the top edge so as to define a tab. A first auxiliary sheet is welded to at least one of the front surface and the back surface of the base sheet to define at least one accessory pocket with the base sheet. A second auxiliary sheet is welded to one of the front surface and the back surface of the base sheet to define a business card pocket with the base sheet. The business card pocket includes a width that is sized to accommodate a first dimension of a business card and to span a width of the tab of the base sheet and including a length that is sized to accommodate a second dimension of the business card.

A divider for a file folder includes a primary sheet made of transparent plastic and having an integrally formed tab that protrudes from a top of the primary sheet. The divider further includes a secondary sheet made of transparent plastic and welded to a surface of the primary sheet to define at least one accessory compartment and a tertiary sheet made of transparent plastic and welded to the surface of the primary sheet to define a business card compartment. A portion of the business card compartment is located adjacent to the tab of the primary sheet and is sized to accommodate a business card.

A method is provided for accessing contents in a file folder. A plurality of inserts in a file folder are searched. Each insert includes a primary sheet having an integrally formed tab that protrudes from a top of the primary sheet, at least one accessory pocket defined by a secondary sheet welded to a surface of the primary sheet and a business card pocket defined by a tertiary sheet welded to a surface of the primary sheet that is adjacent the tab. One of the plurality of inserts in the file folder is selected that includes a select business card in the business card pocket. The select insert is removed from the file folder including all contents related to the select business card that is stored in the at least one accessory pocket.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Described below are multiple different embodiments of removable inserts or dividers that can be used to store contents. Each insert and its contents can be removed from a file folder and transported to a new location without the user having to bring the entire file folder with them. Each insert can act as a divider, includes accessory pockets for storing or holding contents and include a business card pocket located adjacent to a tab that protrudes from a top of the insert. The business card received by the business card pocket can be used to identify the contents of the insert.

Figure 1:
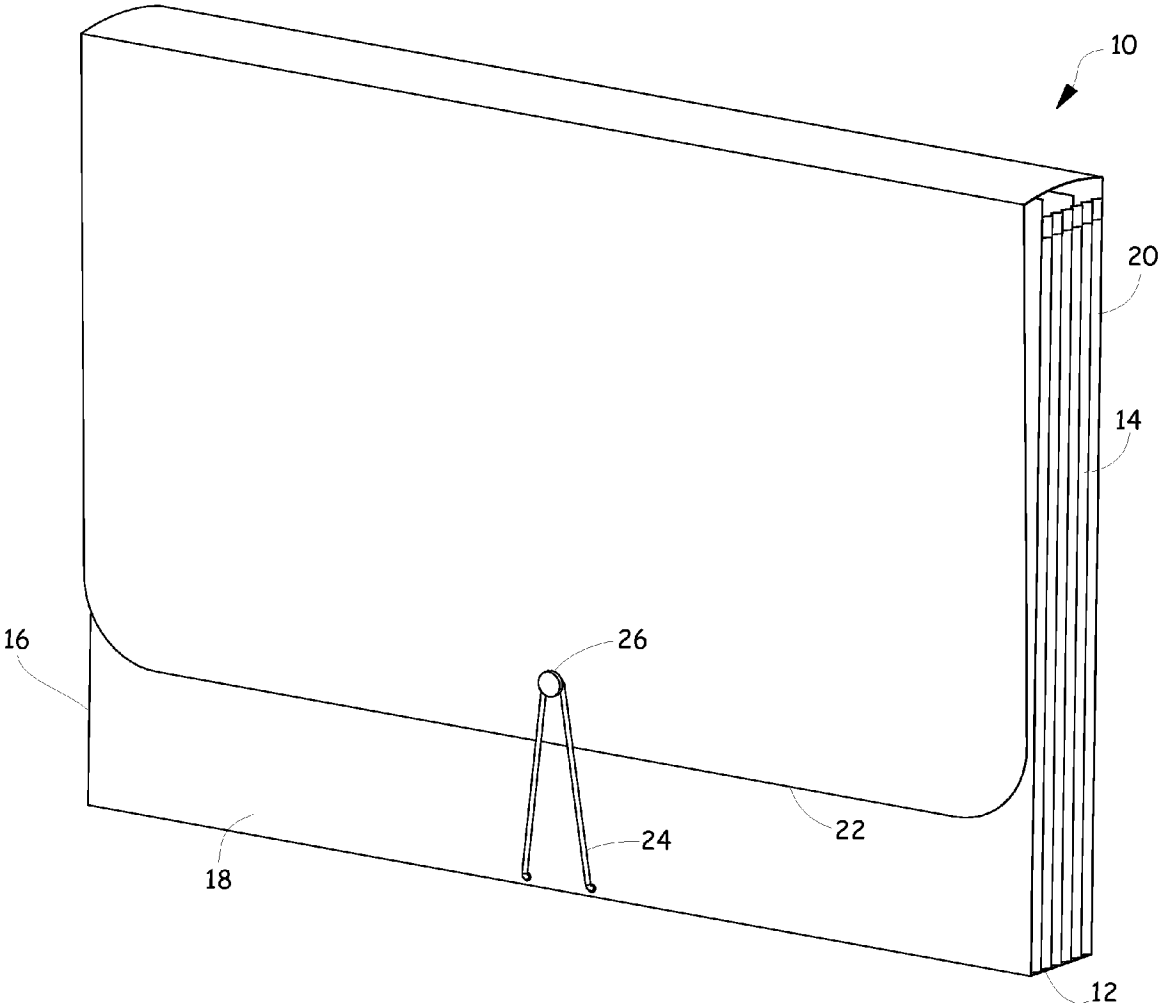
FIG. 1 is a perspective view of an exemplary file folder.

FIG. 1 is a perspective view of an exemplary file folder 10 in a closed position. File folder 10 includes a bottom 12, a pair of opposing sides 14 and 16, a front 18, a back 20 and a top flap or rotatable cover 22 that is secured by a loop 24 and a clasp 26. File folder 10 can be made of a polymer material, such as a polyolefin or polyester. However, other similar materials with similar properties, such as recyclable materials including cardboard, can be used. More particularly, bottom 12, front 18, back 20 and top flap or rotatable cover 22 can be made of a rigid polymer, while the pair of opposing sides 14 and 16 can be made of a more flexible polymer. This can be accomplished by using the same or different polymers throughout file folder 10 or by making the more rigid structural pieces of file folder 10 thicker than the more flexible structural pieces.

Figure 2:
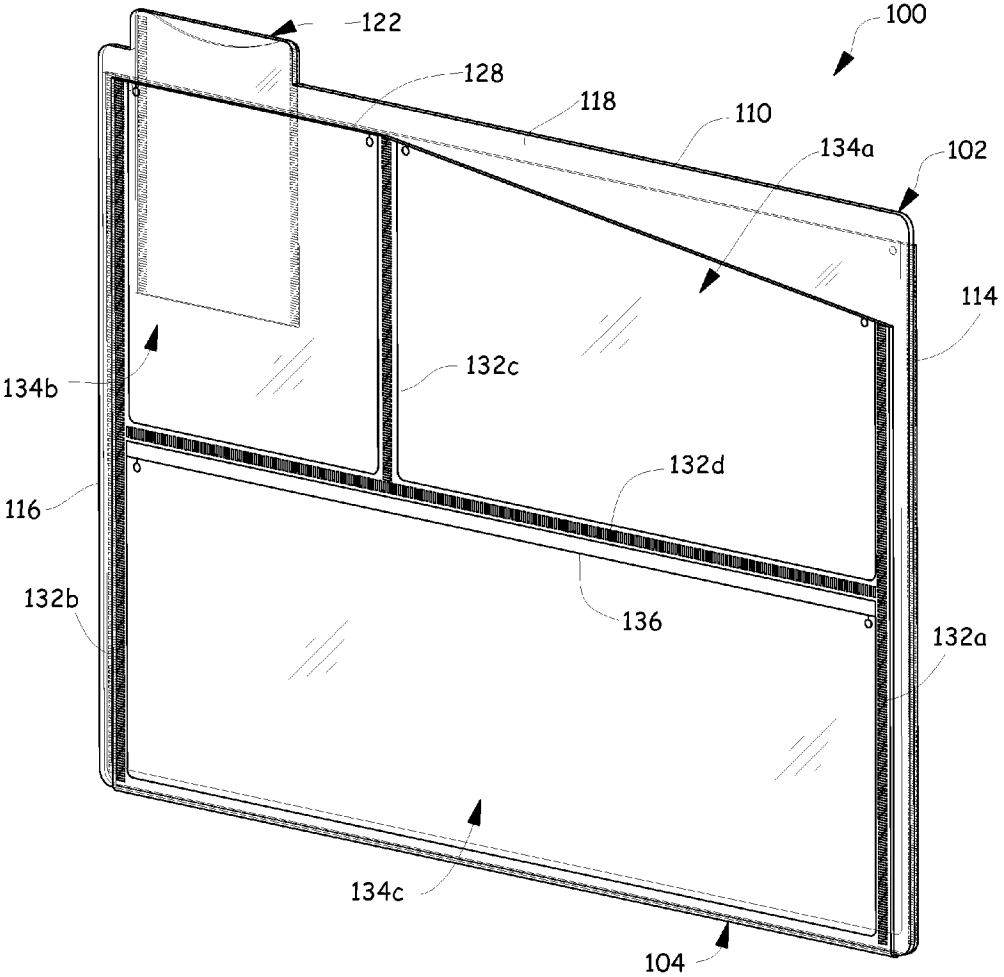
FIG. 2 is a perspective view of an insert for a file folder according to one embodiment.
Figure 3:
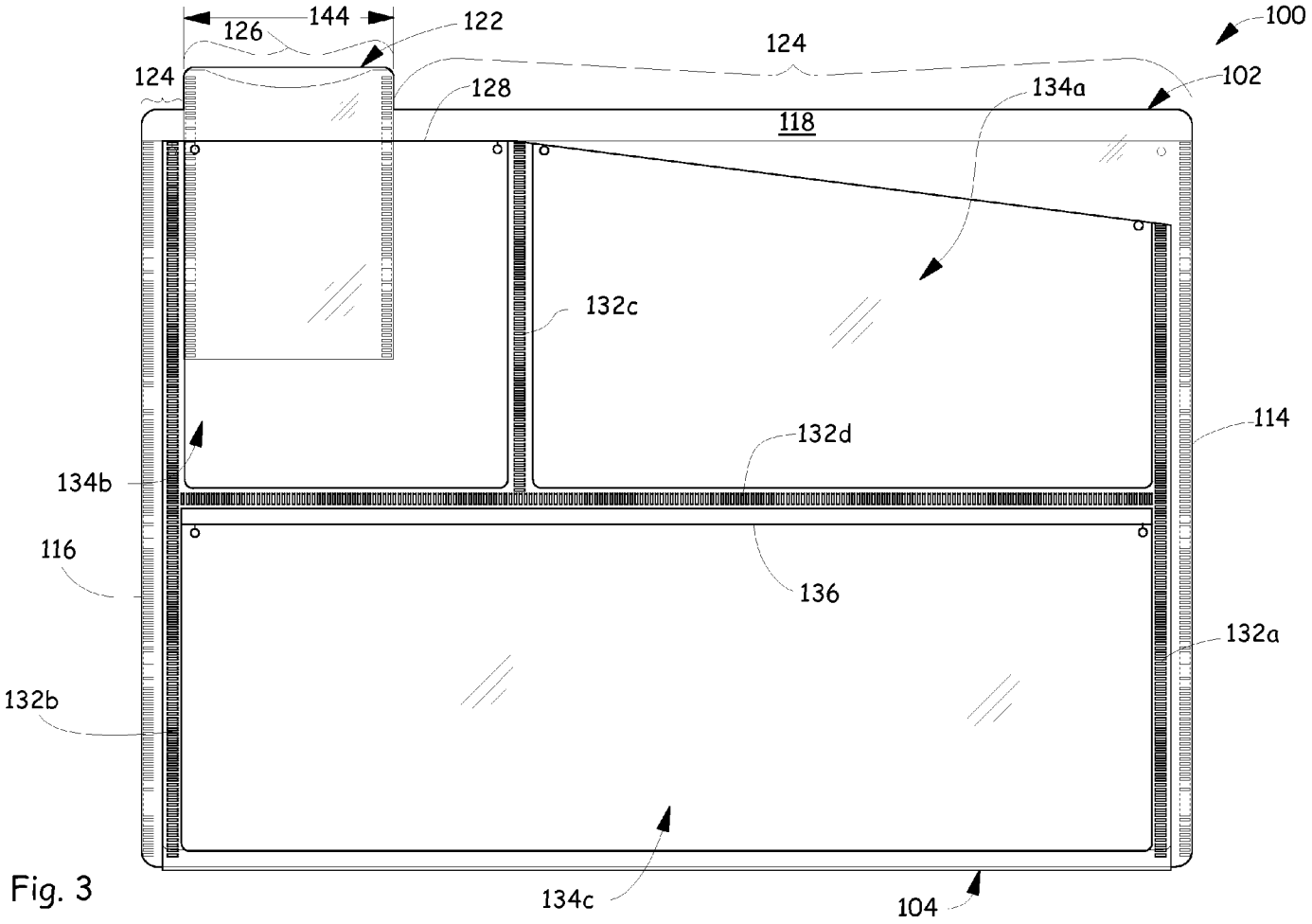
FIG. 3 is a front view of the insert illustrated in FIG. 2.
Figure 5:
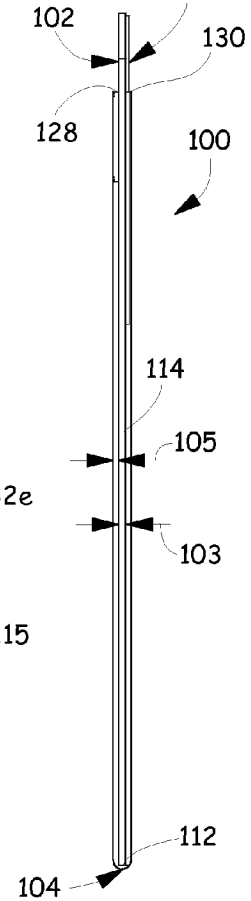
FIG. 5 is a right side view of the insert illustrated in FIG. 2 shown with exaggerated sheet separation for purposes of clarity.
Figure 4:
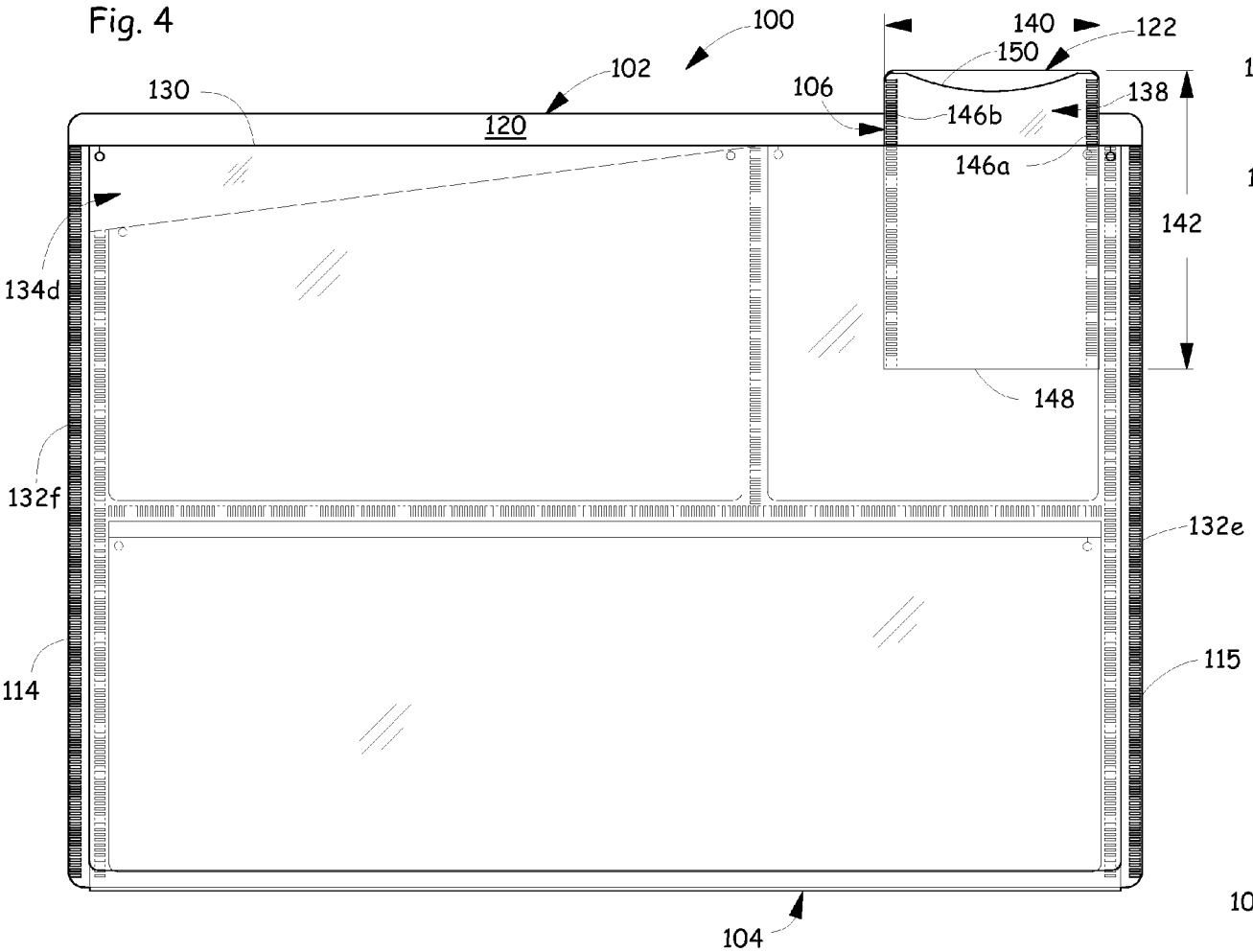
FIG. 4 is a back view of the insert illustrated in FIG. 2.
Figure 7:
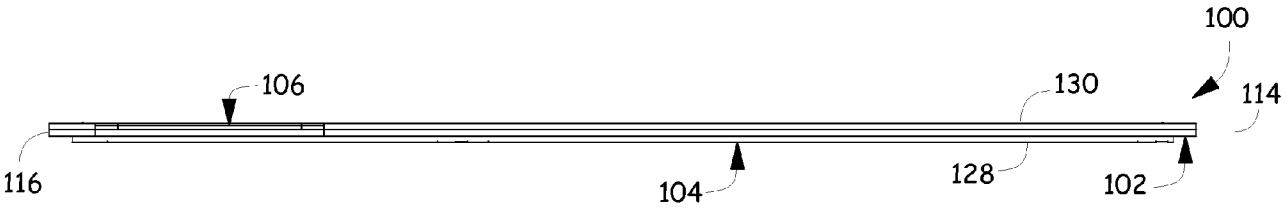
FIG. 7 is a top view of the insert illustrated in FIG. 2 shown with exaggerated sheet thickness for purposes of clarity.
Figure 8:
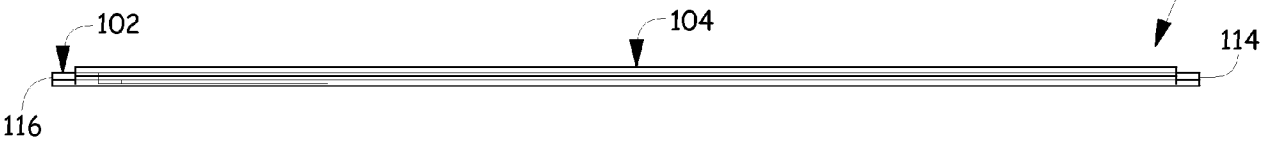
FIG. 8 is a bottom view of the insert illustrated in FIG. 2 shown with exaggerated sheet thickness for purposes of clarity.
Figure 6:
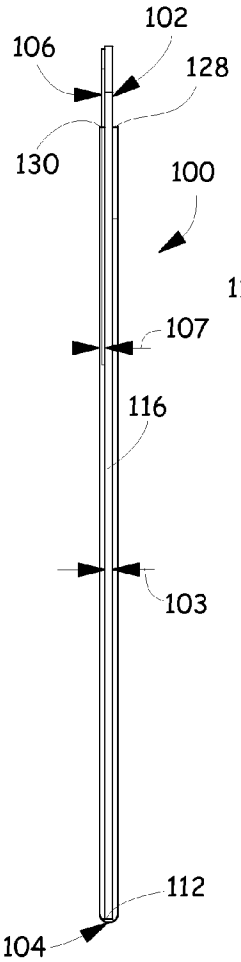
FIG. 6 is a left side view of the insert illustrated in FIG. 2 shown with exaggerated sheet thickness for purposes of clarity.

Inside file folder 10 are at least one insert or divider. Each insert or divider can hold or otherwise store documents, content and the like. FIG. 2 illustrates a perspective view of an insert or divider 100 for exemplary file folder 10 according to one embodiment. A front view, a back view, a right side view, a left side view, a top view and a bottom view of insert or divider 100 are illustrated in FIGS. 3-8. As noted above, the right side view, the left side view, the top view and the bottom view illustrated in FIGS. 5-8 are shown with exaggerated sheet thickness for purposes of clarity.

Insert or divider 100 includes a base or primary sheet 102, a first auxiliary or secondary sheet 104 and a second auxiliary or tertiary sheet 106. In one embodiment, base sheet 102, first auxiliary sheet 104 and second auxiliary sheet 106 are made of a transparent plastic or polymer, such as a polyolefin or polyester. In this way, items or contents being held by insert 100 are visible from outside insert 100.

Base sheet 102 includes a top or top edge 110, a bottom or bottom edge 112, a first side or first side edge 114, an opposing second side or second side edge 116, a front surface 118 and a back surface 120. Base sheet 102 further includes an integrally formed tab 122 that protrudes from top 110 of base sheet 102. In other words, a first portion 124 of top edge 110 is out-of-alignment with a second portion 126 of top edge 110 so as to define tab 122.

First auxiliary sheet or secondary sheet 104 is welded to a surface of base or primary sheet 102 to define at least one accessory compartment. In particular, first auxiliary sheet or secondary sheet 104 is welded to at least one of front surface 118 and back surface 120 to define at least one accessory compartment. First auxiliary sheet 104 includes a sheet thickness 105 that is less than a thickness 103 of base sheet 102. As illustrated in the embodiment in FIGS. 2-8, first auxiliary sheet 104 is welded to back surface 120 of base sheet 102, is wrapped around bottom or bottom edge 112 of base sheet 102 and is further welded to front surface 118 of base sheet 102 so that a first end 128 of first auxiliary sheet 104 is located adjacent front surface 118 of base sheet 102 and a second end 130 of first auxiliary sheet 104 is located adjacent back surface 120 of base sheet 102.

As illustrated in FIGS. 2-8, first auxiliary sheet 104 is welded to front surface 118 and back surface 120 along a plurality of weld lines 132*a*-132*f* to define the at least one accessory pocket or compartment as a plurality of accessory pockets or compartments that are located adjacent front surface 118 and adjacent back surface 120. As illustrated in FIGS. 2-8, insert 100 includes four accessory pockets 134*a*, 134*b*, 134*c* and 134*d*. Accessory pockets 134*a*, 134*b* and 134*c* are formed between the first auxiliary sheet 104 and front surface 118 of base sheet 102, while accessory pocket 134*d* is formed between first auxiliary sheet 104 and back surface 120. Each accessory pocket 134*a*-134*d* formed by first auxiliary sheet 104 welded to base sheet 102 includes an enclosed bottom, first and second sealed sides and an open top.

Accessory pocket 134*a* is defined by weld line 132*d*, which provides the enclosed bottom, and weld lines 132*a* and 132*c*, which provide the first and second sealed sides. Accessory pocket 134*b* is defined by weld line 132*d*, which provides the enclosed bottom, and weld lines 132*b* and 132*c*, which provide the first and second sealed sides. Accessory pocket 134*c* is defined by weld lines 132*a* and 132*b*, which provide the first and second sealed sides. The enclosed bottom of accessory pocket 134*c* is provided by first auxiliary sheet 104 being wrapped around bottom or bottom edge 112 of base sheet 102. Accessory pocket 134*d* is defined by weld lines 132*e* and 132*f*, which provide the first and second sealed sides. The enclosed bottom of accessory pocket 134*d* is provided by first auxiliary sheet 104 being wrapped around bottom or bottom edge 112 of base sheet 102.

The open top of accessory pocket 134*b* is defined by first end 128 of first auxiliary sheet 104 and the open top of accessory pocket 134*d* is defined by second end 130 of first auxiliary sheet 104. Both open tops of accessory pockets 134*b* and 134*d* are substantially horizontal, which makes them substantially parallel to top edge 110 and bottom edge 112 of base sheet 102 and substantially perpendicular to first and second side edges 114 and 116 of base sheet. While accessory pocket 134*a* is also defined by first end 128 of first auxiliary sheet 104, the open top of accessory pocket 134*a* has a tapered edge or is angled relative to the substantially horizontal open tops of accessory pockets 134*b* and 134*d*. The open top of accessory pocket 134*c* is not defined by first end 128 or second end 130 of first auxiliary sheet 104. Rather, a slot 136 is located in first auxiliary sheet 104 that is located adjacent to front surface 118 of base sheet 102. Slot 136 defines the open top of accessory pocket 134*c*. Slot 136 is formed in such a way that the edge that forms the open top of accessory pocket 134*c* is substantially horizontal, which makes it substantially parallel to top edge 110 and bottom edge 112 of base sheet 102 and substantially perpendicular to first and second side edges 114 and 116.

Second auxiliary sheet or tertiary sheet 106 is welded to a surface of base sheet 102 to define a business card pocket or compartment 138. In particular, second auxiliary sheet or tertiary sheet 106 is welded to at least one of front surface 118 and back surface 120 of base sheet 102 to define business card pocket 138. Second auxiliary sheet 106 includes a sheet thickness 107 that is less than thickness 103 of base sheet 102. A portion of business card pocket 138 is located adjacent to tab 122 of base sheet 102 and is sized to accommodate a business card. More particularly, business card pocket 138 includes a width 140 and a length 142. Width 140 is sized to accommodate a first dimension of a business card and to span or have the substantially same width as a width 144 of tab 122. Length 142 of business card pocket 138 is sized to accommodate a second dimension of a business card. Business card pocket 138 is partially located within accessory pocket 134*d* because second auxiliary sheet or tertiary sheet 106 is located between first auxiliary sheet or secondary sheet 104 and base sheet or primary sheet 102.

As illustrated in FIGS. 2-8, second auxiliary sheet 106 is welded to back surface 120 of base sheet 102 by a plurality of weld lines 146*a* and 146*b* so as to define business card pocket 138 that is located adjacent back surface 120 of base sheet 102. Business card pocket 138 includes an open bottom, first and second sealed sides and an open top. Business card pocket 138 is defined by a first end 148 of second auxiliary sheet 106, which provides the open bottom, weld lines 146*a* and 146*b*, which provide the first and second sealed sides, and second end 150, which provides the open top. While first end 148 of second auxiliary sheet 106 is substantially horizontal and therefore substantially parallel to top edge 110 and bottom edge 112 of base sheet 102 and substantially perpendicular to first and second side edges 114 and 116 of base sheet 102, second end 150 is partially scalloped so that at least a portion of second end 150 is located below a top of tab 122.

Figure 9:
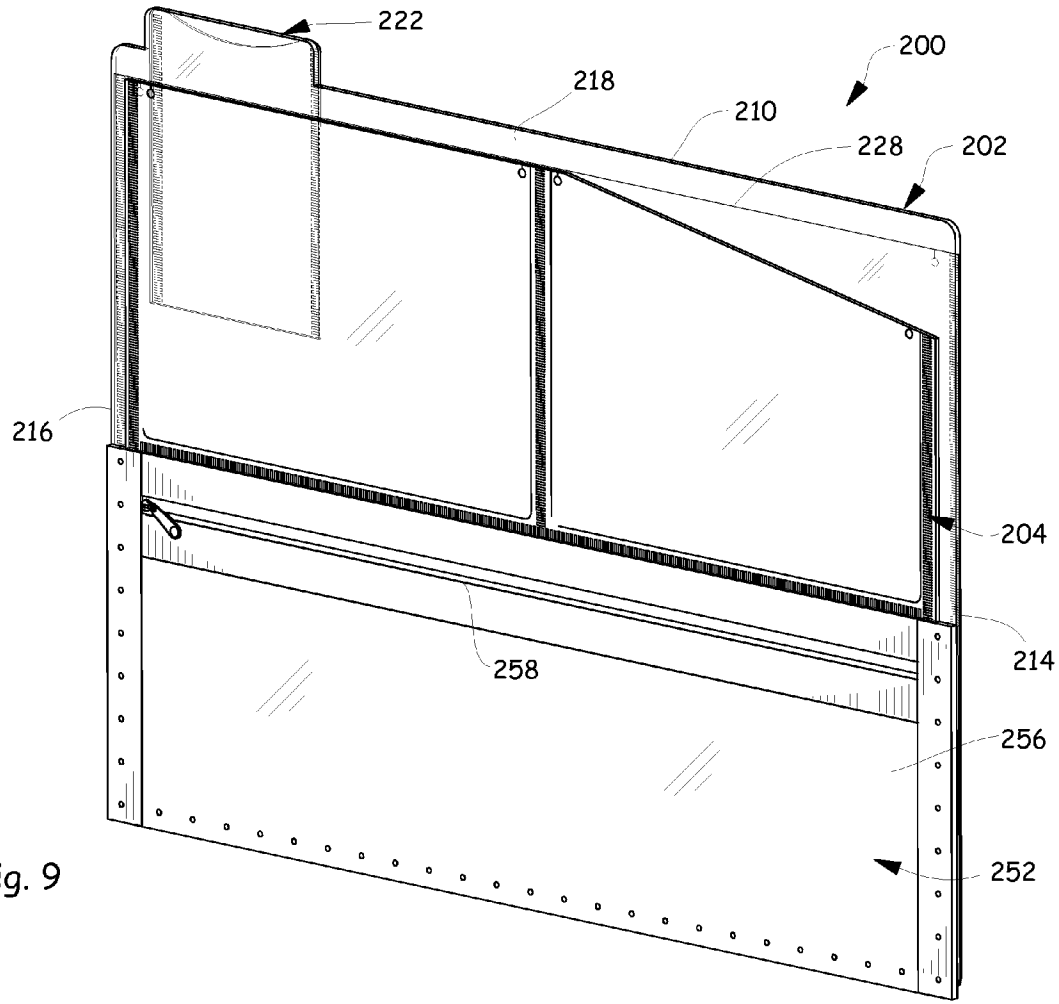
FIG. 9 is a perspective view of an insert for a file folder according to another embodiment.
Figure 10:
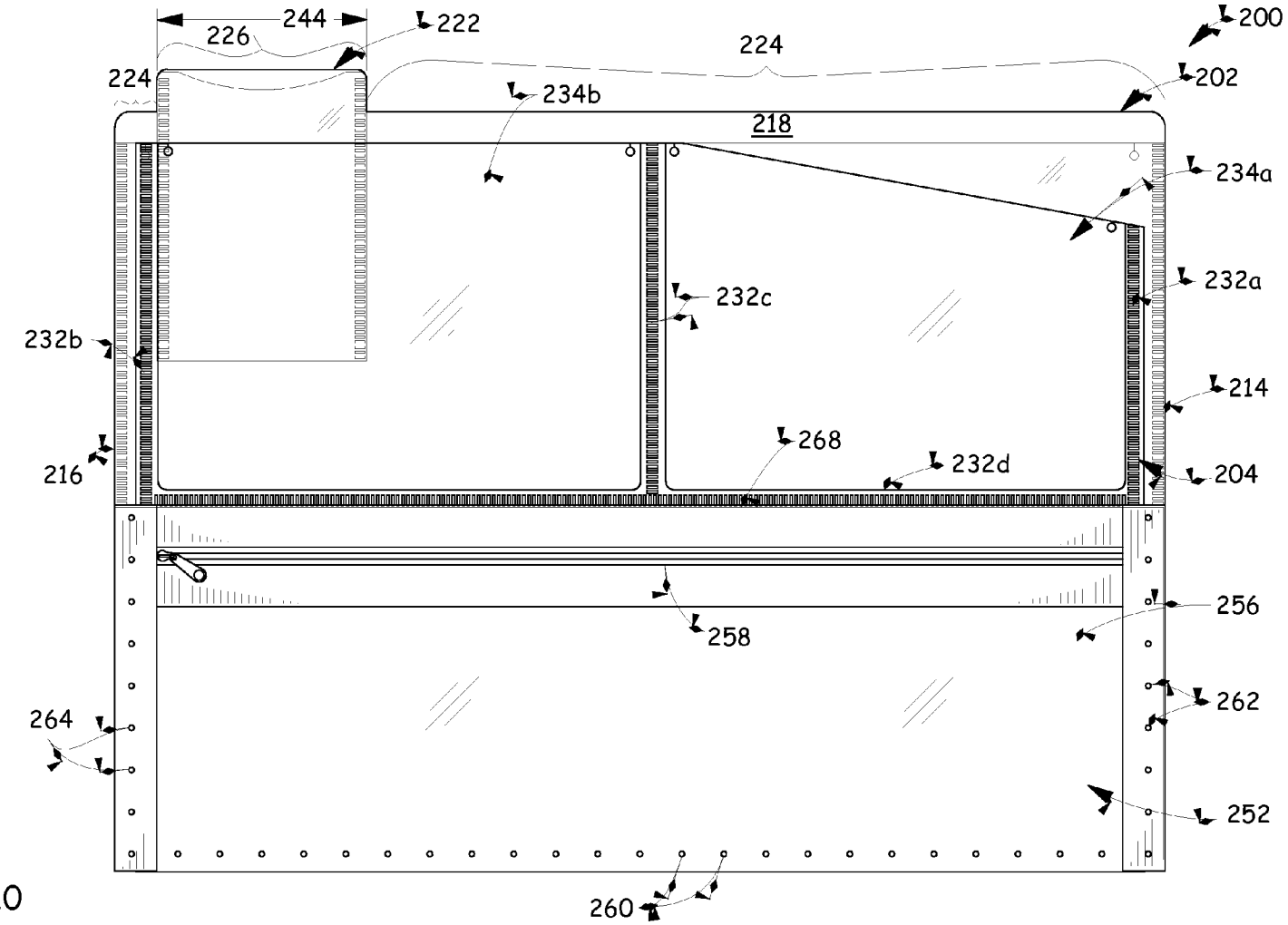
FIG. 10 is a front view of the insert illustrated in FIG. 9.
Figure 12:
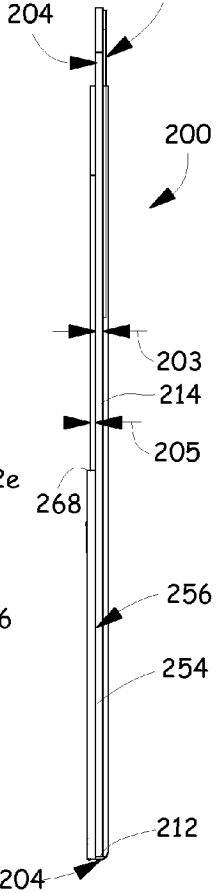
FIG. 12 is a right side view of the insert illustrated in FIG. 9 shown with exaggerated sheet thickness for purposes of clarity.
Figure 11:
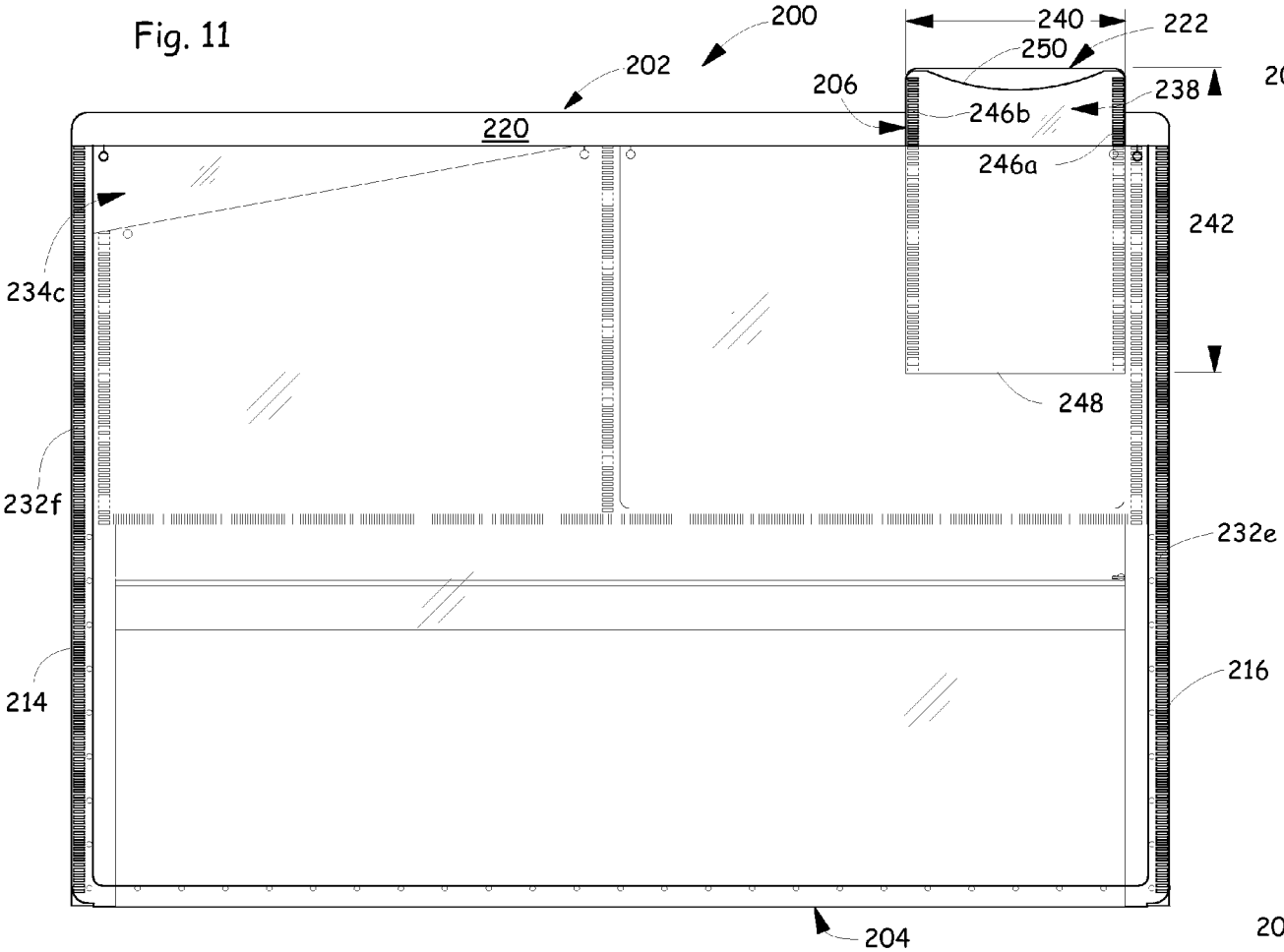
FIG. 11 is a back view of the insert illustrated in FIG. 9.
Figure 14:
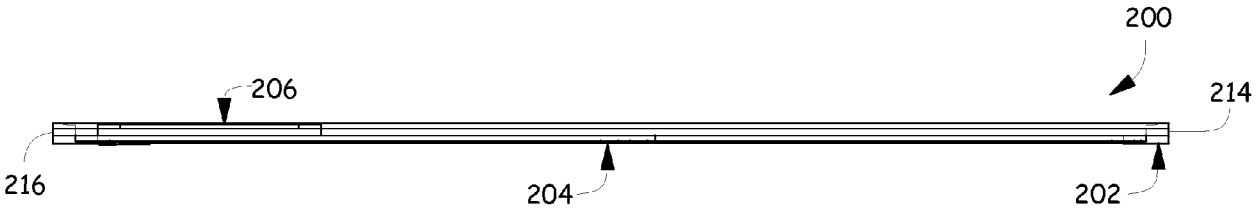
FIG. 14 is a top view of the insert illustrated in FIG. 9 shown with exaggerated sheet thickness for purposes of clarity.
Figure 15:
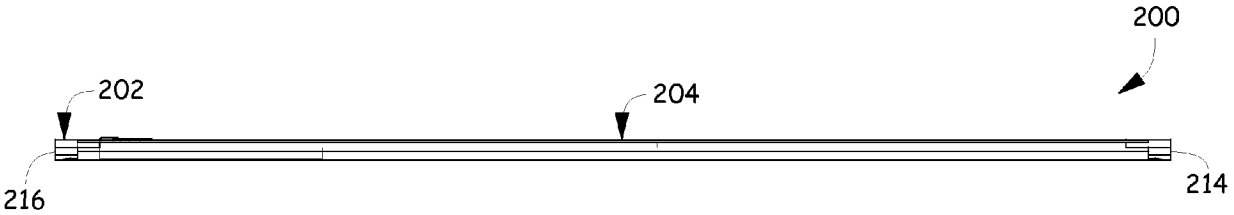
FIG. 15 is a bottom view of the insert illustrated in FIG. 9 shown with exaggerated sheet thickness for purposes of clarity.
Figure 13:
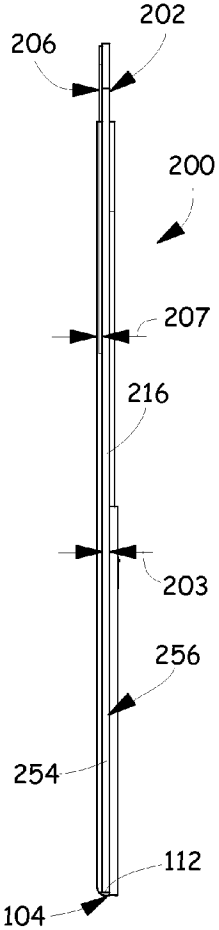
FIG. 13 is a left side view of the insert illustrated in FIG. 9 shown with exaggerated sheet thickness for purposes of clarity.

FIG. 9 illustrates a perspective view of an insert or divider 200 for exemplary file folder 10 according to another embodiment. A front view, a back view, a right side view, a left side view, a top view and a bottom view of insert or divider 200 are illustrated in FIGS. 10-15. As noted above, the right side view, the left side view, the top view and the bottom view illustrated in FIGS. 12-15 are shown with exaggerated sheet thickness for purposes of clarity.

Insert or divider 200 includes a base or primary sheet 202, a first auxiliary or secondary sheet 204 and a second auxiliary or tertiary sheet 206. In one embodiment, base sheet 202, first auxiliary sheet 204 and second auxiliary sheet 206 are made of a transparent plastic or polymer, such as a polyolefin or polyester. In this way, items or contents being held by insert 200 are visible from outside insert 200.

Base sheet 202 includes a top or top edge 210, a bottom or bottom edge 212, a first side or first side edge 214, an opposing second side or second side edge 216, a front surface 218 and a back surface 220. Base sheet 202 further includes an integrally formed tab 222 that protrudes from top 210 of base sheet 202. In other words, a first portion 224 of top edge 210 is out-of-alignment with a second portion 226 of top edge 210 so as to define tab 222.

First auxiliary sheet or secondary sheet 204 is welded to a surface of base or primary sheet 202 to define at least one accessory compartment. In particular, first auxiliary sheet or secondary sheet 204 is welded to at least one of front surface 218 and back surface 220 to define at least one accessory compartment. First auxiliary sheet 204 includes a sheet thickness 205 that is less than a thickness of 203 of base sheet 202. As illustrated in the embodiment in FIGS. 9-15, first auxiliary sheet 204 is welded to back surface 220 of base sheet 202, is wrapped around bottom or bottom edge 212 of base sheet 202 and is further welded to front surface 218 of base sheet 202 so that a first end 228 of first auxiliary sheet 204 is located adjacent front surface 218 of base sheet 202 and a second end 230 of first auxiliary sheet 204 is located adjacent back surface 220 of base sheet 202.

As illustrated in FIGS. 9-15, first auxiliary sheet 204 is welded to front surface 218 and back surface 220 along a plurality of weld lines 232*a*-232*f* to define the at least one accessory pocket or compartment as a plurality of accessory pockets or compartments that are located adjacent front surface 218 and adjacent back surface 220. As illustrated in FIGS. 9-15, insert 200 includes three accessory pockets 234*a*, 234*b* and 234*c*. Accessory pockets 234*a* and 234*b* are formed between first auxiliary sheet 204 and front surface 218 of base sheet 202, while accessory pocket 234*c* is formed between first auxiliary sheet 204 and back surface 220. Each accessory pocket 234*a*-234*c* formed by first auxiliary sheet 204 welded to base sheet 202 includes an enclosed bottom, first and second sealed sides and an open top.

Accessory pocket 234*a* is defined by weld line 232*d*, which provides the enclosed bottom, and weld lines 232*a* and 232*c*, which provide the first and second sealed sides. Accessory pocket 234*b* is defined by weld line 232*d*, which provides the enclosed bottom, and weld lines 232*b* and 232*c*, which provide the first and second sealed sides. Accessory pocket 234*c* is defined by weld lines 232*e* and 232*f*, which provide the first and second sealed sides. The enclosed bottom of accessory pocket 234*c* is provided by first auxiliary sheet 204 being wrapped around bottom or bottom edge 212 of base sheet 202.

The open top of accessory pocket 234*b* is defined by first end 228 of first auxiliary sheet 204 and the open top of accessory pocket 234*c* is defined by second end 230 of first auxiliary sheet 204. The open tops of both accessory pockets 234*b* and 234*c* are substantially horizontal, which makes them substantially parallel to top edge 210 and bottom edge 212 of base sheet 202 and substantially perpendicular to first and second side edges 214 and 216 of base sheet. While accessory pocket 234*a* is also defined by first end 228 of first auxiliary sheet 204, the open top of accessory pocket 234*a* has a tapered edge or is angled relative to the substantially horizontal open tops of accessory pockets 234*b* and 234*c*.

Second auxiliary sheet or tertiary sheet 206 is welded to a surface of base sheet 202 to define a business card pocket or compartment 238. In particular, second auxiliary sheet or tertiary sheet 206 is welded to at least one of front surface 218 and back surface 220 to define business card pocket 238. Second auxiliary sheet 206 includes a sheet thickness 207 that is less than thickness 203 of base sheet 202. A portion of business card pocket 238 is located adjacent to tab 222 of base sheet 202 and is sized to accommodate a business card. More particularly, business card pocket 238 includes a width 240 and a length 242. Width 240 is sized to accommodate a first dimension of a business card and to span or have the substantially same width as a width 244 of tab 222. Length 242 of business card pocket 238 is sized to accommodate a second dimension of a business card. Business card pocket 238 is partially located within accessory pocket 234*c* because second auxiliary sheet or tertiary sheet 206 is located between first auxiliary sheet or secondary sheet 204 and base sheet or primary sheet 202.

As illustrated in FIGS. 9-15, second auxiliary sheet 206 is welded to back surface 220 of base sheet 202 by a plurality of weld lines 246*a* and 246*b* so as to define business card pocket 238 that is located adjacent back surface 220 of base sheet 202. Business card pocket 238 includes an open bottom, first and second sealed sides and an open top. Business card pocket 238 is defined by a first end 248 of second auxiliary sheet 206, which provides the open bottom, weld lines 246*a* and 246*b*, which provide the first and second sealed sides, and second end 250, which provides the open top. While first end 248 of second auxiliary sheet 206 is substantially horizontal and therefore substantially parallel to top edge 210 and bottom edge 212 of base sheet 202 and substantially perpendicular to first and second side edges 214 and 216 of base sheet 202, second end 250 is partially scalloped so that at least a portion of second end 250 is located below a top of tab 222.

Insert 200 further includes a zippered pouch 252 having sides that are welded to one of the front surface and the back surface of the base sheet. As illustrated in the embodiment in FIGS. 9-15, zippered pouch 252 is welded to front surface 218 of base sheet 202 and also a front of first auxiliary sheet or secondary sheet 204. Zippered pouch 252 includes a back panel 254 and a front panel 256. Together, back panel 254 and front panel 256 are welded to base sheet 202 and first auxiliary sheet 204. Pouch 252 includes an enclosed bottom, first and second sealed sides and a zippered opening formed by a zipper 258. The line of dots in FIGS. 9-10 at the base of zippered pouch 252 illustrate welds 260, which provides the enclosed bottom of zippered pouch 252. The line of dots in FIGS. 9-10 at the first and second sides of zippered pouch 252 illustrates welds 262 and 264, which provide the sealed sides of zippered pouch 252. Zipper 258 provides the zippered opening to zippered pouch 252.

Further, between a front surface of first auxiliary 204 and back panel 254 of zippered pouch 252 is an additional accessory pocket 266. Accessory pocket 266 is defined by welds 260, which provide an enclosed bottom, by welds 262 and 264, which provide sealed sides and an open top, which includes a top end 268 of zippered pouch 252. Top end 268 of zippered pouch is substantially horizontal and therefore substantially parallel to top edge 210 and bottom edge 212 of base sheet 202 and substantially perpendicular to first and second side edges 214 and 216 of base sheet 202.

Figure 16:
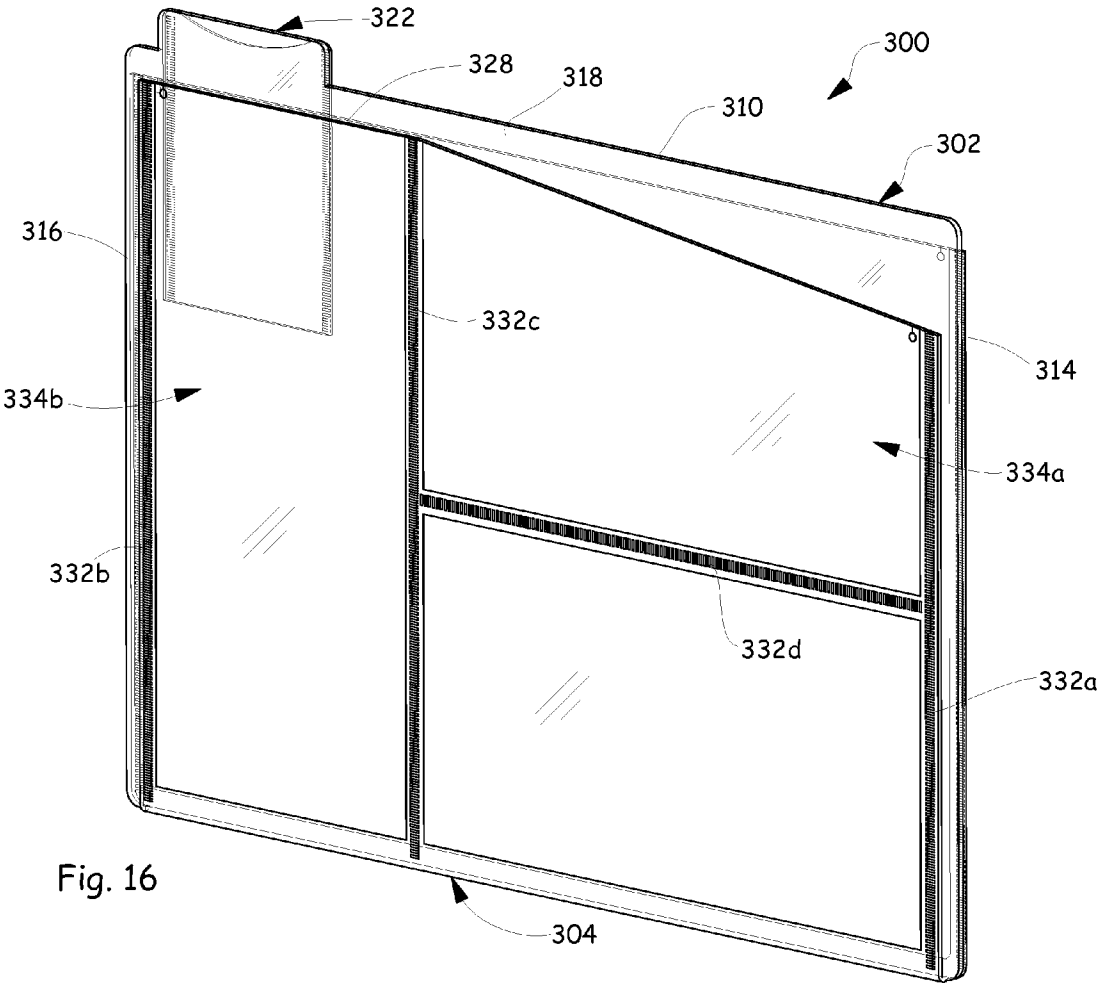
FIG. 16 is a perspective view of an insert for a file folder according to another embodiment.
Figure 17:
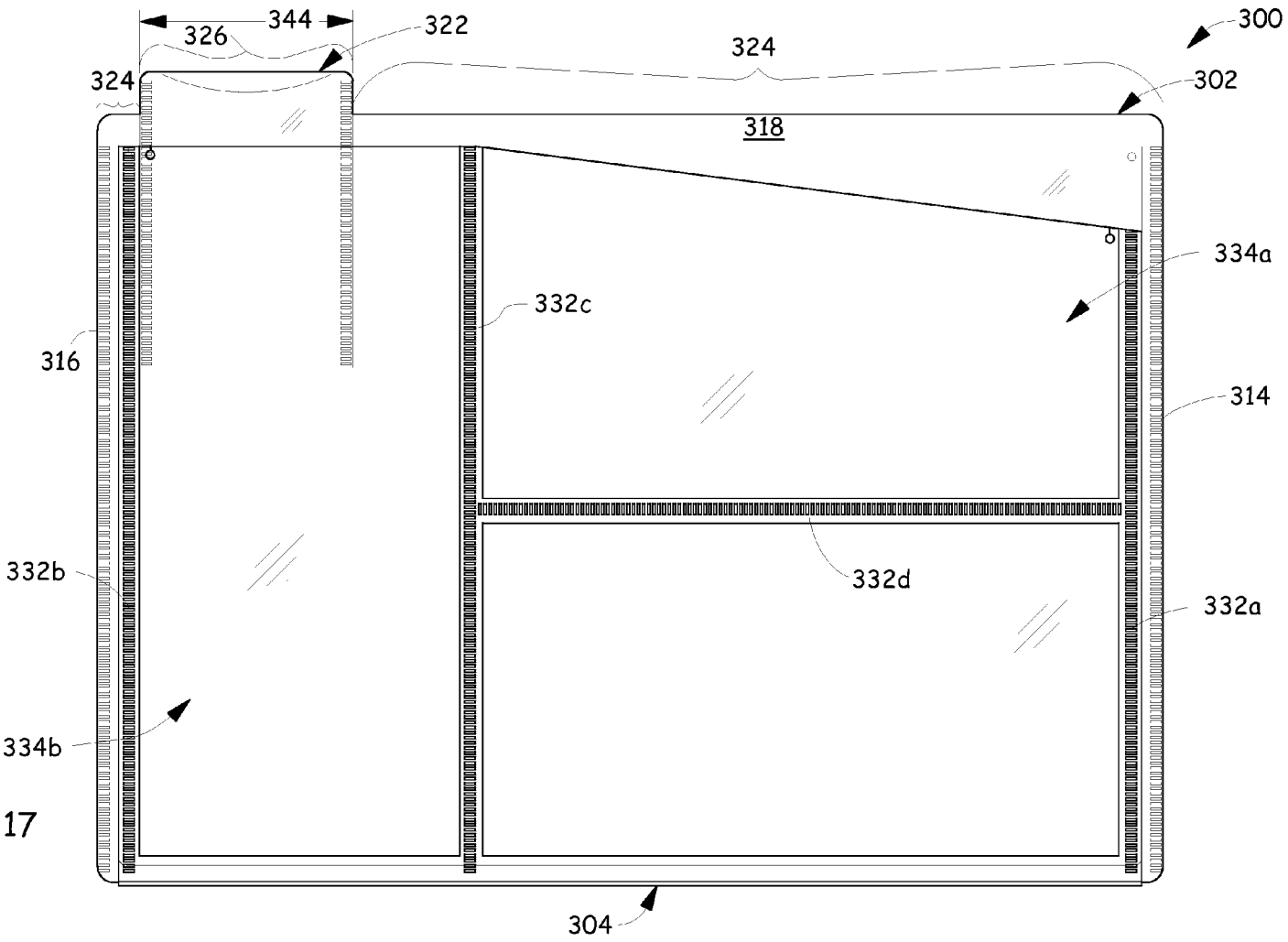
FIG. 17 is a front view of the insert illustrated in FIG. 16.
Figure 19:
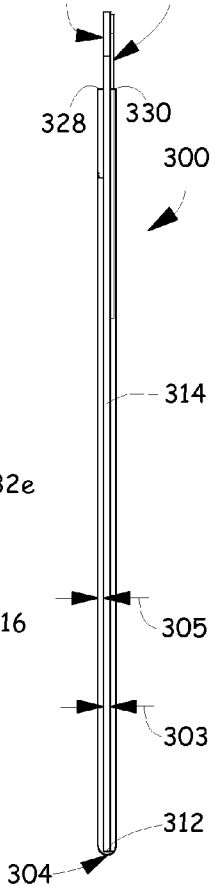
FIG. 19 is a right side view of the insert illustrated in FIG. 16 shown with exaggerated sheet thickness for purposes of clarity.
Figure 18:
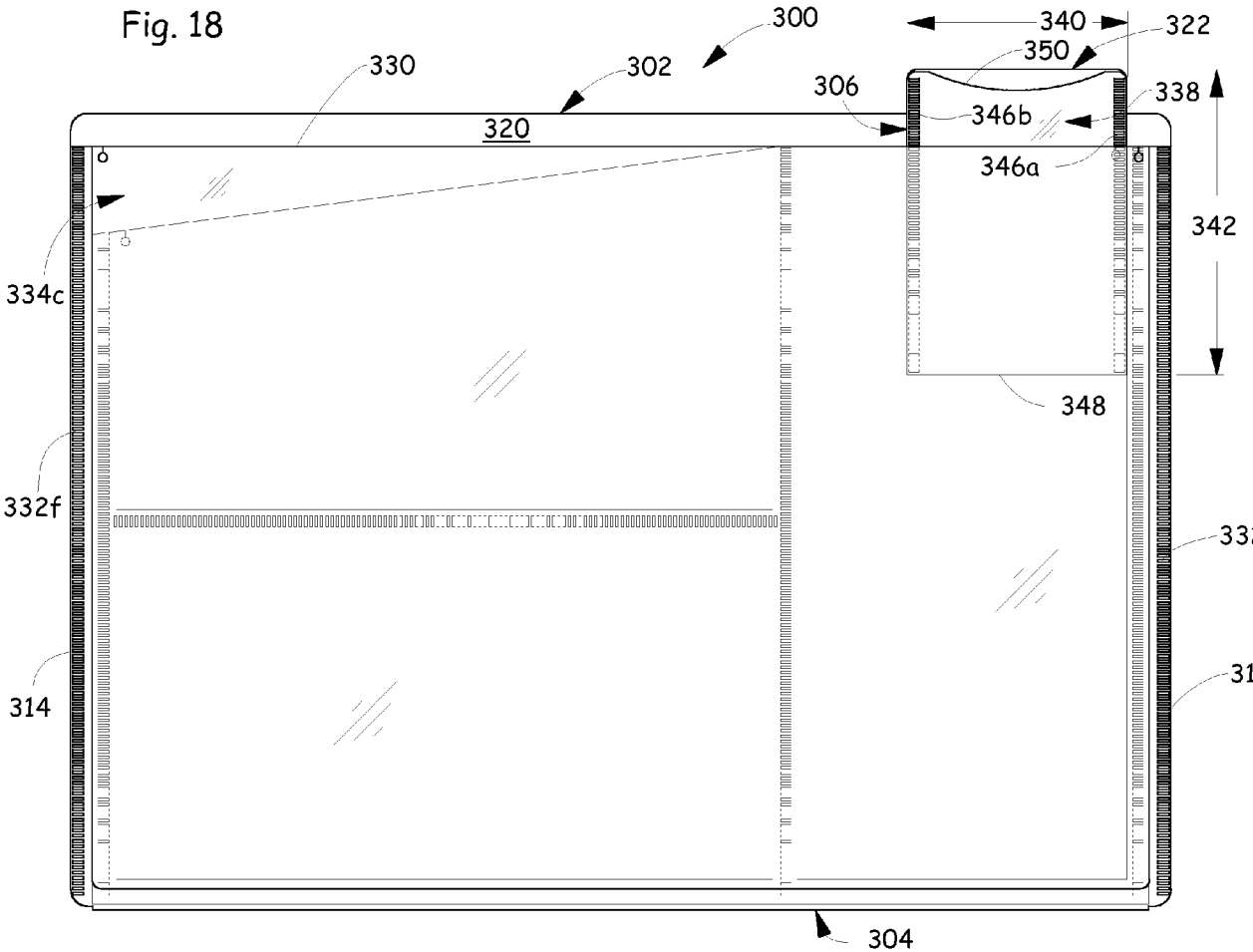
FIG. 18 is a back view of the insert illustrated in FIG. 16.
Figure 21:
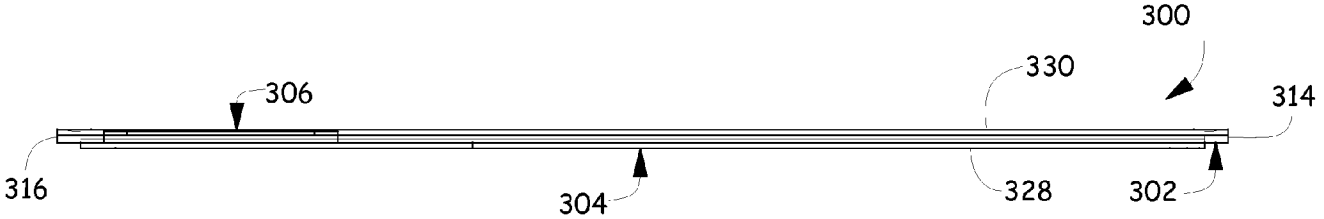
FIG. 21 is a top view of the insert illustrated in FIG. 16 shown with exaggerated sheet thickness for purposes of clarity.
Figure 22:
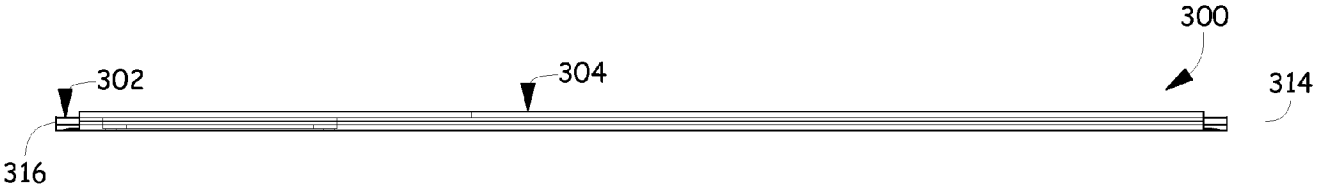
FIG. 22 is a bottom view of the insert illustrated in FIG. 16 shown with exaggerated sheet thickness for purposes of clarity.
Figure 20:
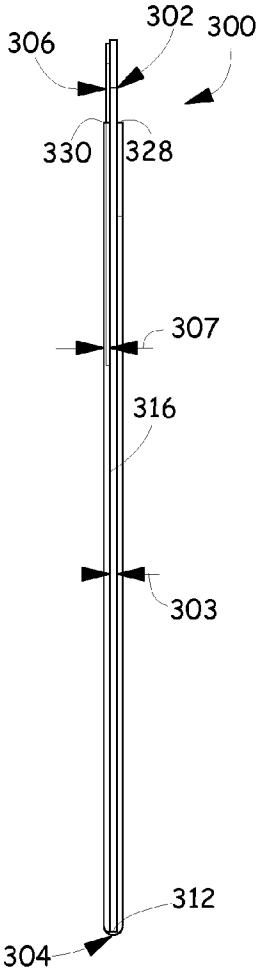
FIG. 20 is a left side view of the insert illustrated in FIG. 16 shown with exaggerated sheet thickness for purposes of clarity.

FIG. 16 illustrates a perspective view of an insert or divider 300 for exemplary file folder 10 according to yet another embodiment. A front view, a back view, a right side view, a left side view, a top view and a bottom view of insert or divider 300 are illustrated in FIGS. 17-22. As noted above, the right side view, the left side view, the top view and the bottom view illustrated in FIGS. 19-22 are shown with exaggerated sheet thickness for purposes of clarity.

Insert or divider 300 includes a base or primary sheet 302, a first auxiliary or secondary sheet 304 and a second auxiliary or tertiary sheet 306. In one embodiment, base sheet 302, first auxiliary sheet 304 and second auxiliary sheet 306 are made of a transparent plastic or polymer, such as a polyolefin or polyester. In this way, items or contents being held by insert 300 are visible from outside insert 300.

Base sheet 302 includes a top or top edge 310, a bottom or bottom edge 312, a first side or first side edge 314, an opposing second side or second side edge 316, a front surface 318 and a back surface 320. Base sheet 302 further includes an integrally formed tab 322 that protrudes from top 310 of base sheet 302. In other words, a first portion 324 of top edge 310 is out-of-alignment with a second portion 326 of top edge 310 so as to define tab 322.

First auxiliary sheet or secondary sheet 304 is welded to a surface of base or primary sheet 302 to define at least one accessory compartment. In particular, first auxiliary sheet or secondary sheet 304 is welded to at least one of front surface 318 and back surface 320 to define at least one accessory compartment. First auxiliary sheet 304 includes a sheet thickness 305 that is less than a thickness of 303 of base sheet 302. As illustrated in the embodiment in FIGS. 16-22, first auxiliary sheet 304 is welded to back surface 320 of base sheet 302, is wrapped around bottom or bottom edge 312 of base sheet 302 and is further welded to front surface 318 of base sheet 302 so that a first end 328 of first auxiliary sheet 304 is located adjacent front surface 318 of base sheet 302 and a second end 330 of first auxiliary sheet 304 is located adjacent back surface 320 of base sheet 302.

As illustrated in FIGS. 16-22, first auxiliary sheet 304 is welded to front surface 318 and back surface 320 along a plurality of weld lines 332*a*-332*f* to define the at least one accessory pocket or compartment as a plurality of accessory pockets or compartments that are located adjacent front surface 318 and adjacent back surface 320. As illustrated in FIGS. 16-22, insert 300 includes three accessory pockets 334*a*, 334*b* and 334*c*. Accessory pockets 334*a* and 334*b* are formed between first auxiliary sheet 304 and front surface 318 of base sheet 302, while accessory pocket 334*c* is formed between first auxiliary sheet 304 and back surface 320. Each accessory pocket 334*a*-334*c* formed by first auxiliary sheet 304 welded to base sheet 302 includes an enclosed bottom, first and second sealed sides and an open top.

Accessory pocket 334*a* is defined by weld line 332*d*, which provides the enclosed bottom, and weld lines 332*a* and 332*c*, which provide the first and second sealed sides. Accessory pocket 334*b* is defined by weld lines 332*b* and 332*c*, which provide the first and second sealed sides. The enclosed bottom of accessory pocket 334*b* is provided by first auxiliary sheet 304 being wrapped around bottom or bottom edge 312 of base sheet 302. Accessory pocket 334*c* is defined by weld lines 332*e* and 332*f*, which provide the first and second sealed sides. Like accessory pocket 334*b*, the enclosed bottom of accessory pocket 334*c* is provided by first auxiliary sheet 304 being wrapped around bottom or bottom edge 312 of base sheet 302.

The open top of accessory pocket 334*b* is defined by first end 328 of first auxiliary sheet 304 and the open top of accessory pocket 334*c* is defined by second end 330 of first auxiliary sheet 304. The open tops of both accessory pockets 334*b* and 334*c* are substantially horizontal, which makes them substantially parallel to top edge 310 and bottom edge 312 of base sheet 302 and substantially perpendicular to first and second side edges 314 and 316 of base sheet. While accessory pocket 334*a* is also defined by first end 328 of first auxiliary sheet 304, the open top of accessory pocket 334*a* has a tapered edge or is angled relative to the substantially horizontal open tops of accessory pockets 334*b* and 334*c*.

Second auxiliary sheet or tertiary sheet 306 is welded to a surface of base sheet 302 to define a business card pocket or compartment 338. In particular, second auxiliary sheet or tertiary sheet 306 is welded to at least one of front surface 318 and back surface 320 to define business card pocket 338. Second auxiliary sheet 306 includes a sheet thickness 307 that is less than thickness 303 of base sheet 302. A portion of business card pocket 338 is located adjacent to tab 322 of base sheet 302 and is sized to accommodate a business card. More particularly, business card pocket 338 includes a width 340 and a length 342. Width 340 is sized to accommodate a first dimension of a business card and to span or have the substantially same width as a width 344 of tab 322. Length 342 of business card pocket 338 is sized to accommodate a second dimension of a business card. Business card pocket 338 is partially located within accessory pocket 334*c* because second auxiliary sheet or tertiary sheet 306 is located between first auxiliary sheet or secondary sheet 304 and base sheet or primary sheet 302.

As illustrated in FIGS. 16-22, second auxiliary sheet 306 is welded to back surface 320 of base sheet 302 by a plurality of weld lines 346*a* and 346*b* so as to define business card pocket 338 that is located adjacent back surface 320 of base sheet 302. Business card pocket 338 includes an open bottom, first and second sealed sides and an open top. Business card pocket 338 is defined by a first end 348 of second auxiliary sheet 306, which provides the open bottom, weld lines 346*a* and 346*b*, which provide the first and second sealed sides, and second end 350, which provides the open top. While first end 348 of second auxiliary sheet 306 is substantially horizontal and therefore substantially parallel to top edge 310 and bottom edge 312 of base sheet 302 and substantially perpendicular to first and second side edges 314 and 316 of base sheet 302, second end 350 is partially scalloped so that at least a portion of second end 350 is located below a top of tab 322.

Figure 23:
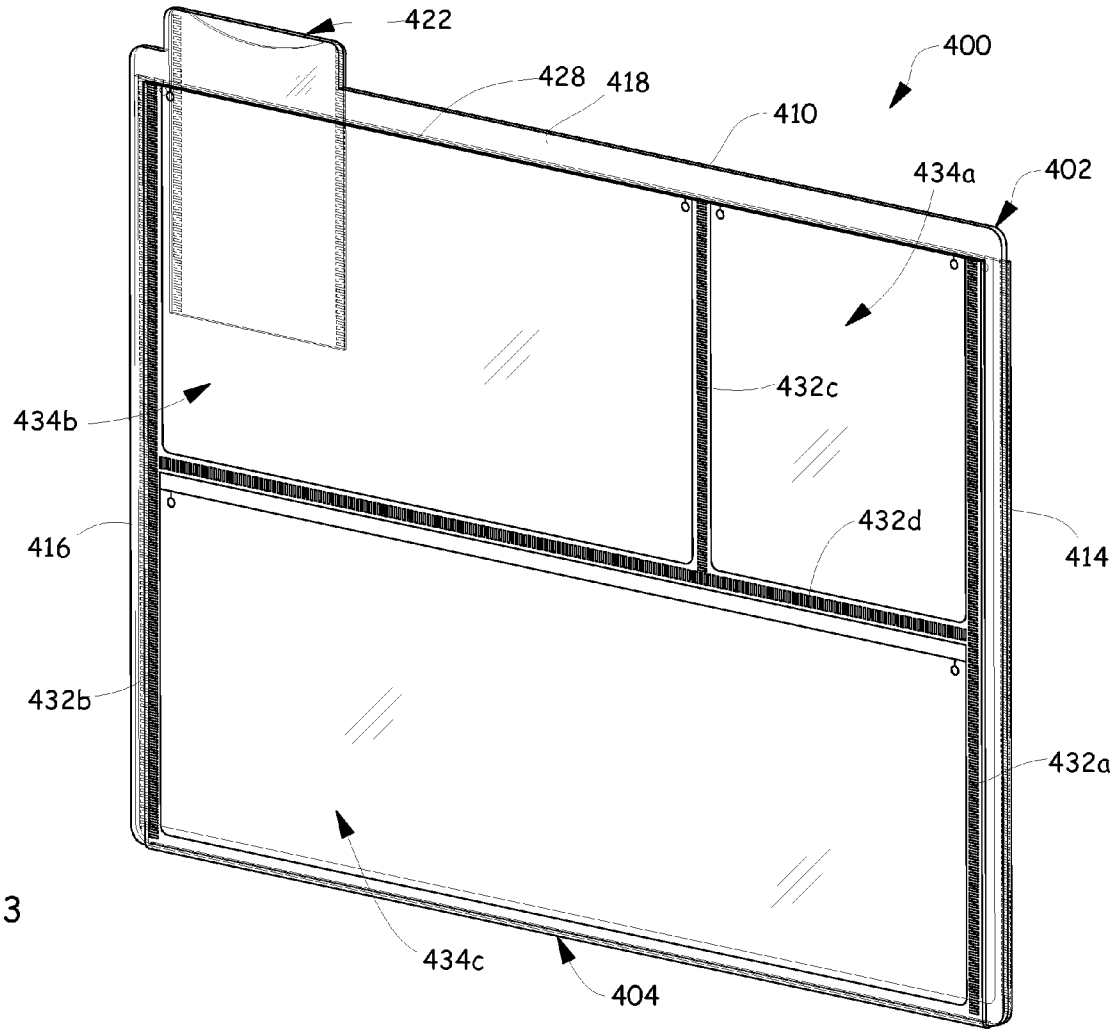
FIG. 23 is a perspective view of an insert for a file folder according to yet another embodiment.
Figure 24:
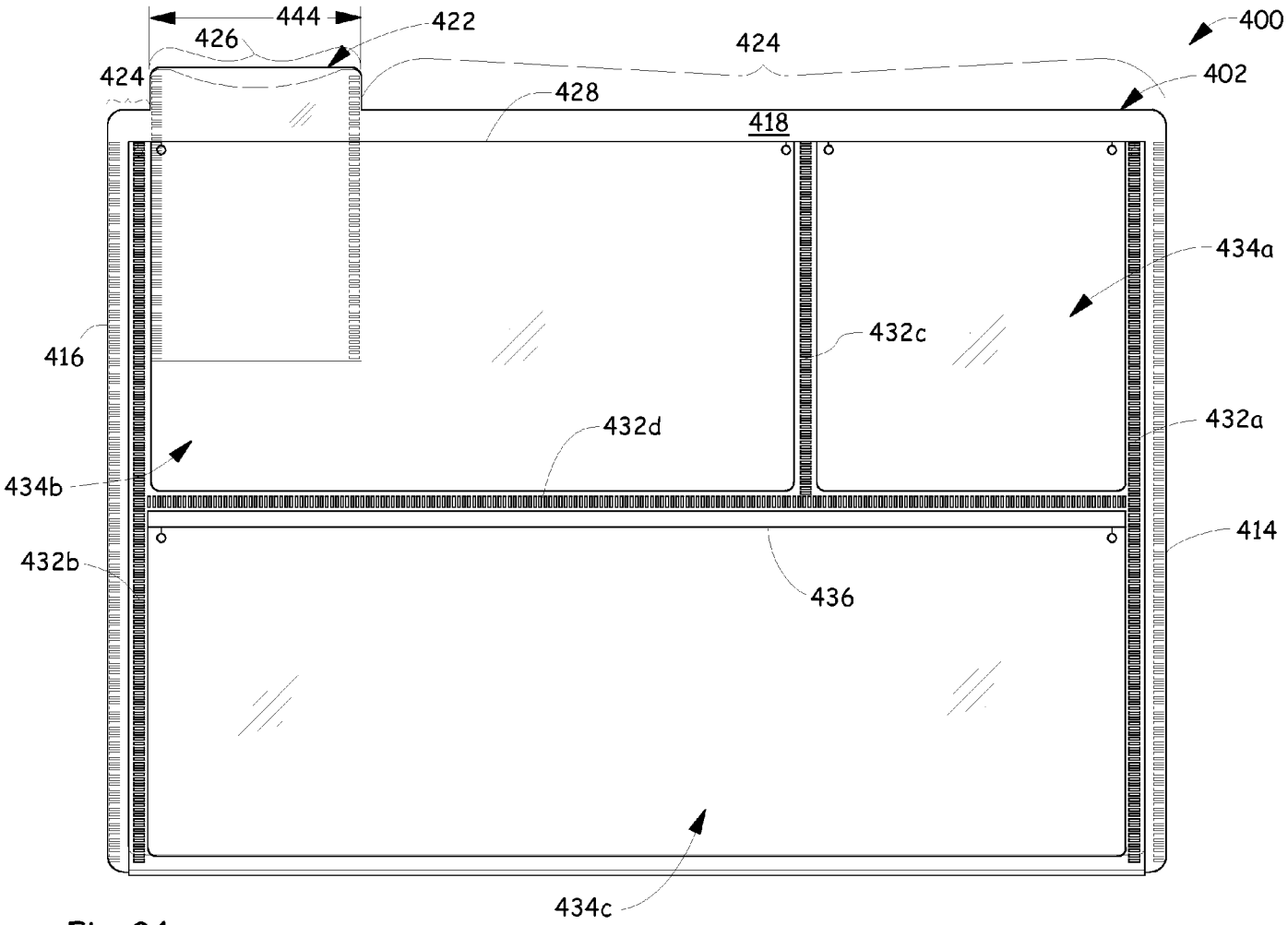
FIG. 24 is a front view of the insert illustrated in FIG. 23.
Figures 25, 26:
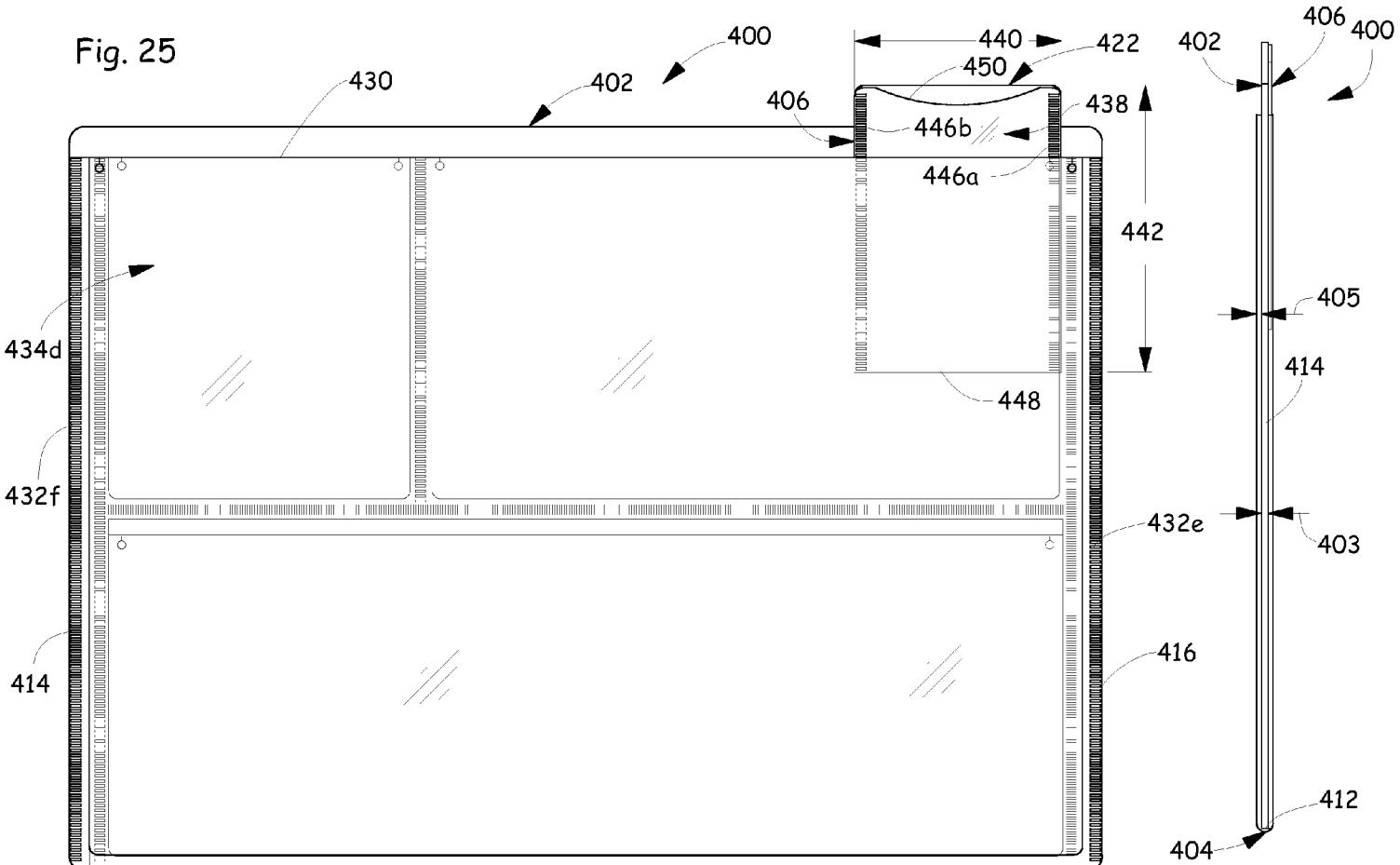
FIG. 25 is a back view of the insert illustrated in FIG. 23.
FIG. 26 is a right side view of the insert illustrated in FIG. 23 shown with exaggerated sheet thickness for purposes of clarity.
Figures 27, 28, 29:
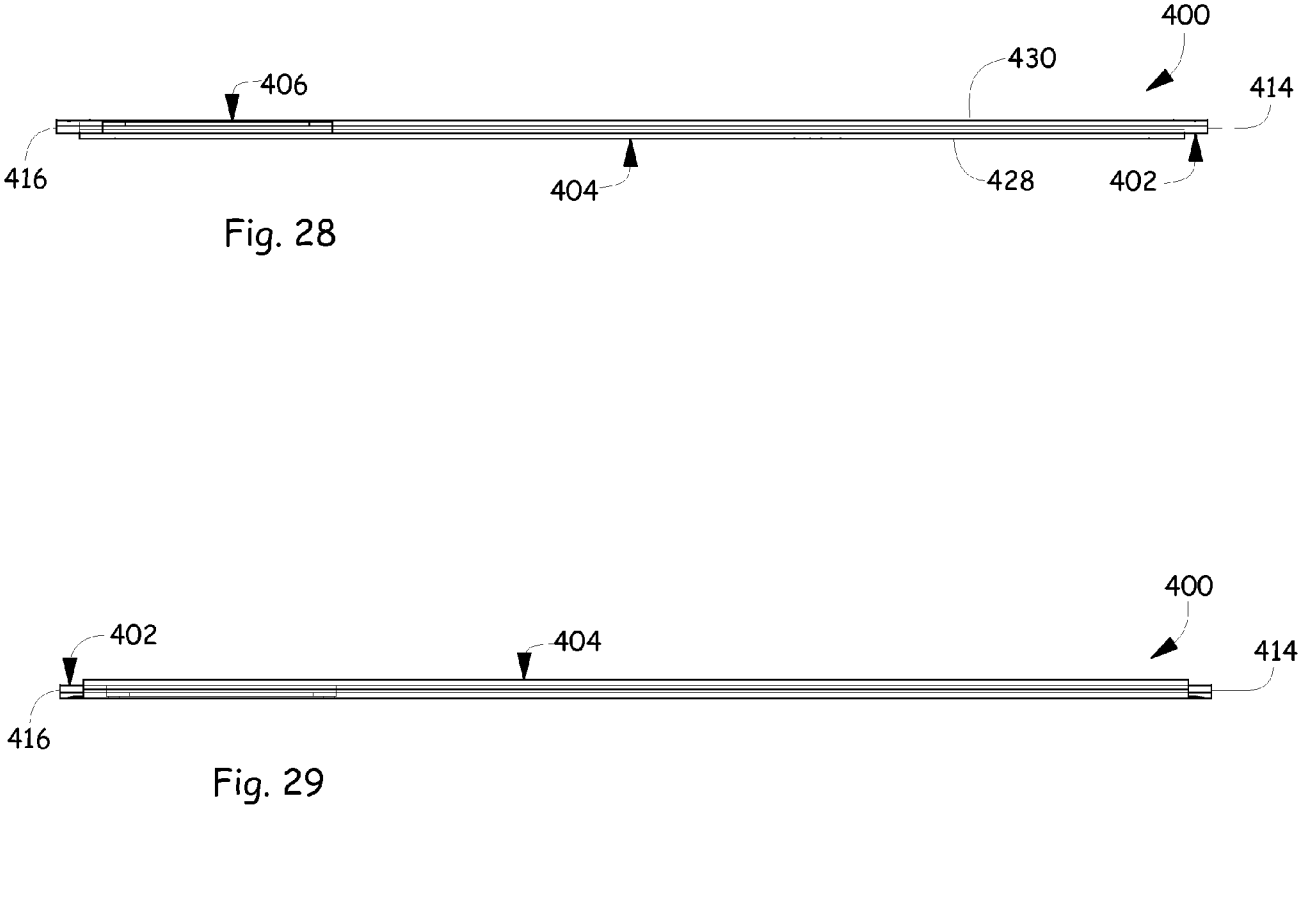
FIG. 27 is a left side view of the insert illustrated in FIG. 23 shown with exaggerated sheet thickness for purposes of clarity.
FIG. 28 is a top view of the insert illustrated in FIG. 23 shown with exaggerated sheet thickness for purposes of clarity.
FIG. 29 is a bottom view of the insert illustrated in FIG. 23 shown with exaggerated sheet thickness for purposes of clarity.

FIG. 23 illustrates a perspective view of an insert or divider 400 for exemplary file folder 10 according to yet another embodiment. A front view, a back view, a right side view, a left side view, a top view and a bottom view of insert or divider 400 are illustrated in FIGS. 24-29. As noted above, the right side view, the left side view, the top view and the bottom view illustrated in FIGS. 24-29 are shown with exaggerated sheet thickness for purposes of clarity.

Insert or divider 400 includes a base or primary sheet 402, a first auxiliary or secondary sheet 404 and a second auxiliary or tertiary sheet 406. In one embodiment, base sheet 402, first auxiliary sheet 404 and second auxiliary sheet 406 are made of a transparent plastic or polymer, such as a polyolefin or polyester. In this way, items or contents being held by insert 400 are visible from outside insert 400.

Base sheet 402 includes a top or top edge 410, a bottom or bottom edge 412, a first side or first side edge 414, an opposing second side or second side edge 416, a front surface 418 and a back surface 420. Base sheet 402 further includes an integrally formed tab 422 that protrudes from top 410 of base sheet 402. In other words, a first portion 424 of top edge 410 is out-of-alignment with a second portion 426 of top edge 410 so as to define tab 422.

First auxiliary sheet or secondary sheet 404 is welded to a surface of base or primary sheet 402 to define at least one accessory compartment. In particular, first auxiliary sheet or secondary sheet 404 is welded to at least one of front surface 418 and back surface 420 to define at least one accessory compartment. First auxiliary sheet 404 includes a sheet thickness 405 that is less than a thickness 403 of base sheet 402. As illustrated in the embodiment in FIGS. 23-29, first auxiliary sheet 404 is welded to back surface 420 of base sheet 402, is wrapped around bottom or bottom edge 412 of base sheet 402 and is further welded to front surface 418 of base sheet 402 so that a first end 428 of first auxiliary sheet 404 is located adjacent front surface 418 of base sheet 402 and a second end 430 of first auxiliary sheet 404 is located adjacent back surface 420 of base sheet 402.

As illustrated in FIGS. 23-29, first auxiliary sheet 404 is welded to front surface 418 and back surface 420 along a plurality of weld lines 432*a*-432*f* to define the at least one accessory pocket or compartment as a plurality of accessory pockets or compartments that are located adjacent front surface 418 and adjacent back surface 420. As illustrated in FIGS. 23-29, insert 400 includes four accessory pockets 434*a*, 434*b*, 434*c* and 434*d*. Accessory pockets 434*a*, 434*b* and 434*c* are formed between the first auxiliary sheet 404 and front surface 418 of base sheet 402, while accessory pocket 434*d* is formed between first auxiliary sheet 404 and back surface 420. Each accessory pocket 434*a*-434*d* formed by first auxiliary sheet 404 welded to base sheet 402 includes an enclosed bottom, first and second sealed sides and an open top.

Accessory pocket 434*a* is defined by weld line 432*d*, which provides the enclosed bottom, and weld lines 432*a* and 432*c*, which provide the first and second sealed sides. Accessory pocket 434*b* is defined by weld line 432*d*, which provides the enclosed bottom, and weld lines 432*b* and 432*c*, which provide the first and second sealed sides. Accessory pocket 434*c* is defined by weld lines 432*a* and 432*b*, which provide the first and second sealed sides. The enclosed bottom of accessory pocket 434*c* is provided by first auxiliary sheet 404 being wrapped around bottom or bottom edge 412 of base sheet 402. Accessory pocket 434*d* is defined by weld lines 432*e* and 432*f*, which provide the first and second sealed sides. The enclosed bottom of accessory pocket 434*d* is provided by first auxiliary sheet 404 being wrapped around bottom or bottom edge 412 of base sheet 402.

The open top of accessory pockets 434*a* and 434*b* are defined by first end 428 of first auxiliary sheet 404 and the open top of accessory pocket 434*d* is defined by second end 430 of first auxiliary sheet 404. The open tops of accessory pockets 434*a*, 434*b* and 434*d* are substantially horizontal, which makes them substantially parallel to top edge 410 and bottom edge 412 of base sheet 402 and substantially perpendicular to first and second side edges 414 and 416 of base sheet 402. The open top of accessory pocket 434*c* is not defined by first end 428 or second end 430 of first auxiliary sheet 404. Rather, a slot 436 is located in first auxiliary sheet 404 that is located adjacent to front surface 418 of base sheet 402. Slot 436 defines the open top of accessory pocket 434*c*. Slot 436 is formed in such a way that the edge that forms the open top of accessory pocket 434*c* is substantially horizontal, which makes it substantially parallel to top edge 410 and bottom edge 412 of base sheet 402 and substantially perpendicular to first and second side edges 414 and 416.

Second auxiliary sheet or tertiary sheet 406 is welded to a surface of base sheet 402 to define a business card pocket or compartment 438. In particular, second auxiliary sheet or tertiary sheet 406 is welded to at least one of front surface 418 and back surface 420 of base sheet 402 to define business card pocket 438. Second auxiliary sheet 406 includes a sheet thickness 407 that is less than thickness 403 of base sheet 402. A portion of business card pocket 438 is located adjacent to tab 422 of base sheet 402 and is sized to accommodate a business card. More particularly, business card pocket 438 includes a width 440 and a length 442. Width 440 is sized to accommodate a first dimension of a business card and to span or have the substantially same width as a width 444 of tab 422. Length 442 of business card pocket 438 is sized to accommodate a second dimension of a business card. Business card pocket 438 is partially located within accessory pocket 434*d* because second auxiliary sheet or tertiary sheet 406 is located between first auxiliary sheet or secondary sheet 404 and base sheet or primary sheet 402.

As illustrated in FIGS. 23-29, second auxiliary sheet 406 is welded to back surface 420 of base sheet 402 by a plurality of weld lines 446*a* and 446*b* so as to define business card pocket 438 that is located adjacent back surface 420 of base sheet 402. Business card pocket 438 includes an open bottom, first and second sealed sides and an open top. Business card pocket 438 is defined by a first end 448 of second auxiliary sheet 406, which provides the open bottom, weld lines 446*a* and 446*b*, which provide the first and second sealed sides, and second end 450, which provides the open top. While first end 448 of second auxiliary sheet 406 is substantially horizontal and therefore substantially parallel to top edge 410 and bottom edge 412 of base sheet 402 and substantially perpendicular to first and second side edges 414 and 416 of base sheet 402, second end 450 is partially scalloped so that at least a portion of second end 450 is located below a top of tab 422.

Inserts 100, 200, 300 and 400 aid in organizing contents for a user in a file folder, such as file folder 10. Therefore, a method of accessing contents in a file folder is provided. A user searches through a plurality of inserts (for example, of the type 100) in a file folder, each insert 100 includes a primary sheet 102 having an integrally formed tab 122 that protrudes from a top of primary sheet 102. At least one accessory pocket (i.e., 134*a*, 134*b*, 134*c* and 134*d*) is defined by a secondary sheet 104 that is welded to a surface of primary sheet 102. A business card pocket 138 is defined by a tertiary sheet 106 that is welded to a surface of primary sheet 102 that is adjacent tab 122. One of the plurality of inserts 100 in the file folder that includes a select business card in the business card pocket is selected. The select insert 100 from the file folder is removed and includes all contents related to the select business card that is stored in the at least one accessory pocket.

The user can further transport the select insert 100 and the contents of the select insert 100 away from the file folder. Further, the user can return the select insert 100 and the contents of the select insert 100 back into the file folder when the user is finished accessing the contents in the select insert 100.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An insert for a file folder comprising:

a base sheet having a top edge, a bottom edge, a front surface and a back surface, wherein a first portion of the top edge is out-of-alignment with a second portion of the top edge so as to define a tab having a width;

a first auxiliary sheet welded to at least one of the front surface and the back surface of the base sheet to define at least one accessory pocket with the base sheet; and a second auxiliary sheet welded to one of the front surface and the back surface of the base sheet to define a business card pocket with the base sheet, the business card pocket including a width that is sized to accommodate a first dimension of a business card and a length that is sized to accommodate a second dimension of the business card, wherein the width of the business card pocket is less than the length of the business card pocket; and wherein a portion of the business card pocket is positioned on the tab of the base sheet and oriented such that the width of the business card pocket spans the width of the tab and the length of the business card pocket extends into an area of the base sheet that is below the tab so that the width of the tab is minimized to allow for as many varying positions of the tab as possible on the top edge of the base sheet.

2. The insert of claim 1, wherein the second auxiliary sheet is located between the first auxiliary sheet and the base sheet.

3. The insert of claim 1, wherein the business card pocket comprises an open bottom, first and second sealed sides and an open top, the open bottom being defined by a first end of the second auxiliary sheet and the open top being defined by a second end of the second auxiliary sheet.

4. The insert of claim 1, wherein the first auxiliary sheet is welded to the back surface of the base sheet, is wrapped around the bottom edge of the base sheet and is further welded to the front surface of the base sheet so that a first end of the first auxiliary sheet is located adjacent the front surface of the base sheet and an opposing second end of the first auxiliary sheet is located adjacent the back surface of the base sheet.

5. The insert of claim 4, wherein the first auxiliary sheet is welded to the base sheet along a plurality of weld lines to define the at least one accessory pocket as a plurality of accessory pockets that are located adjacent the back surface of the base sheet and adjacent the front surface of the base sheet.

6. The insert of claim 5, wherein each accessory pocket formed by the first auxiliary sheet welded to the base sheet comprises an enclosed bottom, first and second sealed sides and an open top.

7. The insert of claim 6, wherein the open top of at least one of the plurality of accessory pockets comprises a tapered edge.

8. The insert of claim 6, wherein the open top of at least one of the plurality of accessory pockets is formed from a slot in the first auxiliary sheet.

9. The insert of claim 1, further comprising a zippered pouch having sides that are welded to one of the front surface and the back surface of the base sheet.

10. The insert of claim 9, wherein the zippered pouch includes a back panel that defines an additional accessory pocket that is formed with at least the base sheet.

11. The insert of claim 1, wherein the first auxiliary sheet and the second auxiliary sheet have a thickness that is less than a thickness of the base sheet.

12. A divider for a file folder comprising:

a primary sheet made of transparent plastic and having an integrally formed tab that protrudes from a top of the primary sheet, where in the tab includes a width;

a secondary sheet made of transparent plastic and welded to a surface of the primary sheet to define at least one accessory compartment; and a tertiary sheet made of transparent plastic and welded to the surface of the primary sheet to define a business card compartment that accommodates a business card, wherein the tertiary sheet includes a length that is greater than a width of the tertiary sheet; and wherein a portion of the tertiary sheet is located on the tab of the primary sheet and is oriented such that the width of the tertiary sheet extends across the width of the tab and the length of the tertiary sheet extends below the tab on the primary sheet so that the width of the tab is minimized to allow for as many varying positions of the tab protruding from the top of the primary sheet as possible.

13. The divider of claim 12, wherein the secondary sheet is welded to a front surface of the primary sheet, is wrapped around a bottom of the primary sheet and is welded to a back surface of the primary sheet.

14. The divider of claim 12, wherein the tertiary sheet is located between the secondary sheet and the primary sheet.

15. The divider of claim 12, wherein the secondary sheet and the tertiary sheet comprise a thickness that is less than a thickness of the primary sheet.

16. The divider of claim 12, further comprising a zippered pouch having sides that are welded to the surface of the primary sheet, wherein the zippered pouch includes a back panel that defines an additional accessory pocket with the primary sheet.

17. A method of accessing contents in a file folder, the method comprising:

searching through a plurality of inserts in a file folder, each insert including a primary sheet having an integrally formed tab that protrudes from a top of the primary sheet, at least one accessory pocket defined by a secondary sheet welded to a surface of the primary sheet and a business card pocket defined by a tertiary sheet having a length that is greater than a width and being welded to a surface of the primary sheet, wherein the tertiary sheet is positioned on the tab of the primary sheet and oriented such that the width of the tertiary sheet spans a width of the tab and the length of the tertiary sheet extends into an area of the primary sheet that is below the tab so that the width of the tab is minimized to allow for as many varying positions of the tab protruding from the top of the primary sheet as possible;

selecting one of the plurality of inserts in the file folder that includes a select business card in the business card pocket; and removing the select insert from the file folder including all contents related to the select business card that are stored in the at least one accessory pocket.

18. The method of claim 17, wherein the primary sheet, the secondary sheet and the tertiary sheet of each insert are made of a transparent plastic for ease of viewing the business card located in the business card pocket and the contents stored in the at least one accessory pocket.

19. The method of claim 17, further comprising transporting the select insert and the contents of the select insert away from the file folder.

20. The method of claim 19, further comprising returning the select insert and the contents of the select insert back into the file folder.

* * * * *